US010563473B2

(12) United States Patent
Volgmann et al.

(10) Patent No.: US 10,563,473 B2
(45) Date of Patent: Feb. 18, 2020

(54) METHOD AND APPARATUS FOR RETRIEVING A TUBING FROM A WELL

(71) Applicant: Qinterra Technologies AS, Stavanger (NO)

(72) Inventors: Marco Volgmann, Braunschweig (DE); Bard Martin Tinnen, Stavanger (NO)

(73) Assignee: Qinterra Technologies AS, Stavanger (NO)

( * ) Notice: Subject to any disclaimer, the term of this patent is extended or adjusted under 35 U.S.C. 154(b) by 418 days.

(21) Appl. No.: 15/320,853

(22) PCT Filed: Jun. 23, 2015

(86) PCT No.: PCT/NO2015/050113
§ 371 (c)(1),
(2) Date: Dec. 21, 2016

(87) PCT Pub. No.: WO2015/199548
PCT Pub. Date: Dec. 30, 2015

(65) Prior Publication Data

US 2017/0159388 A1 Jun. 8, 2017

(30) Foreign Application Priority Data

Jun. 27, 2014 (NO) ..... 20140825

(51) Int. Cl.
*E21B 31/16* (2006.01)
*E21B 23/14* (2006.01)
(Continued)

(52) U.S. Cl.
CPC ..... *E21B 31/16* (2013.01); *E21B 17/07* (2013.01); *E21B 17/206* (2013.01); *E21B 23/14* (2013.01);
(Continued)

(58) Field of Classification Search
CPC ..... E21B 23/14; E21B 31/00; E21B 31/16; E21B 31/20; E21B 29/00; E21B 29/005
See application file for complete search history.

(56) References Cited

U.S. PATENT DOCUMENTS 2,880,804 A * 4/1959 Fredd ..... E21B 29/00 166/55.8
2,904,114 A * 9/1959 Webb ..... E21B 27/00 166/113
(Continued)

FOREIGN PATENT DOCUMENTS

CA 2850915 A1 * 5/2013 ..... E21B 31/16
GB 2486592 A * 6/2012 ..... E21B 4/003
(Continued)

OTHER PUBLICATIONS

Standards Norway, Norsok Standard D-010, Well integrity in drilling and well operations, Aug. 3, 2004. Lysaker Norway.

*Primary Examiner* — Jennifer H Gay
(74) *Attorney, Agent, or Firm* — Gable Gotwals

(57) ABSTRACT

An interface tool and apparatus for retrieving a tubing from a well at least partly filled with a liquid, the tubing having first and second end portions. The apparatus includes an anchor for engaging tubing; sealing module for sealing first end portion of the bore of tubing; injector for injecting a low density fluid into tubing in or at an elevation below sealing module; and sealing cable connecting to a surface of the well. Apparatus includes first and second tool string sections, and interface tool configured for connecting first tool string section and second tool string section.

10 Claims, 8 Drawing Sheets

(51) Int. Cl.

| | |
|---|---|
| ***E21B 17/07*** | (2006.01) |
| ***E21B 17/20*** | (2006.01) |
| ***E21B 29/00*** | (2006.01) |
| ***E21B 31/20*** | (2006.01) |
| ***E21B 33/12*** | (2006.01) |
| ***E21B 19/00*** | (2006.01) |

(52) U.S. Cl.
CPC ..... *E21B 29/005* (2013.01); *E21B 31/20* (2013.01); *E21B 33/12* (2013.01); *E21B 19/008* (2013.01)

(56) References Cited

U.S. PATENT DOCUMENTS 3,019,840 A * 2/1962 Kennard ..... E21B 29/00 166/237
3,079,999 A * 3/1963 Green ..... E21B 29/00 166/62
3,957,118 A * 5/1976 Barry ..... E21B 17/003 166/385
5,074,361 A * 12/1991 Brisco ..... E21B 29/00 166/240
5,253,710 A * 10/1993 Carter ..... E21B 31/20 166/216
5,388,776 A 2/1995 Childre
9,702,211 B2 * 7/2017 Tinnen ..... E21B 31/00
2007/0165487 A1 * 7/2007 Nutt ..... E21B 31/18 367/25
2009/0090508 A1 * 4/2009 Brouse ..... E21B 7/20 166/289
2009/0101345 A1 * 4/2009 Moffitt ..... E21B 7/20 166/285
2010/0258289 A1 * 10/2010 Lynde ..... E21B 23/14 166/55.7
2014/0116675 A1 * 5/2014 Ocalan ..... E21B 41/00 166/66.4
2014/0352976 A1 * 12/2014 Tinnen ..... E21B 31/00 166/377
2017/0159388 A1 * 6/2017 Volgmann ..... E21B 23/14

FOREIGN PATENT DOCUMENTS

| | | | |
|---|---|---|---|
| GB | 2486592 | A | 6/2012 |
| WO | 2008107774 | A2 | 9/2008 |
| WO | 2013115655 | A1 | 8/2013 |

* cited by examiner

METHOD AND APPARATUS FOR RETRIEVING A TUBING FROM A WELL

CROSS-REFERENCE TO RELATED APPLICATIONS

This United States application is the National Phase of PCT Application No. PCT/NO2015/050113 filed 23 Jun. 2015 which claims priority to Norwegian Patent Application No. 20140825 filed 27 Jun. 2014, each being incorporated herein by reference.

The invention relates to an interface tool for connecting a first tool string section with a second tool string section. The invention further relates to an apparatus for retrieving a tubing from a well, wherein the apparatus comprises such interface tool. The invention also relates to a method for retrieving a tubing from a well comprising such apparatus.

Wells, associated with the production of hydrocarbons, commonly require work-over or well intervention operations to maintain the production of hydrocarbons. A tool string assembly, hereinafter also denoted tool string or bottom hole assembly, which is used to perform such well intervention operations in a well, for instance, removing debris or milling scale, is commonly deployed on wireline and/or coiled tubing. Furthermore, coiled tubing bottom hole assemblies may also be used for re-entry drilling operations.

While drilling a wellbore, for instance a sidetrack, using a coiled tubing drilling bottom hole assembly, a significant amount of solids has to be returned within the mud, pumped through the coiled tubing, the bottom hole assembly and back to surface via the annulus.

Especially for long distance and/or horizontal wellbores and low pump rates these solid particles may remain inside the wellbore section, forcing the respective operator and service company to interrupt drilling operation just for cleaning the already existing wellbore, for instance, to reduce the risk of getting stuck in the wellbore. Therefore the bottom hole assembly is pulled back while mud is continuously pumped through at least the coiled tubing; if the bottom hole assembly is equipped with special flow ports, opening a short circuit from the internal flow bore to the annulus; else mud is pumped through the entire bottom hole assembly, commonly including a downhole mud motor, and thus by driving the drill bit during the entire operation, potentially damaging the wellbore.

However, drilling but also other well intervention operations bear the risk, that a bottom hole assembly, especially if deployed on wireline and/or coiled tubing, may get stuck in the well unintentionally. Because of the risk of getting stuck in the well and having also very limited applicable pull force of wireline and coiled tubing, bottom hole assemblies, deployed on wireline and/or coiled tubing are commonly equipped with prior art release tools, to recover at least the wireline or coiled tubing if the bottom hole assembly got stuck. Thus, in the event of a stuck bottom hole assembly, at least a part of the bottom hole assembly is left in the well, but provided with a defined geometry, also referred as fishing neck, enabling operator and service company to recover the remaining part with more robust fishing equipment.

Prior art release tools are usually surface controlled and/or having an internal battery powered logic timer, for instance, as backup system. According to their purpose prior art release tools remain separated after activation providing said fishing neck, to engage and recover the remaining tool string section with more robust fishing equipment.

Another example of prior art release tools are known as setting tools, also referred as running tools. This type of wireline or coiled tubing downhole tool is used to place and set other downhole equipment, such as packers or plugs and leave this equipment in the well intentionally.

In any of the described scenarios communication and/or power supply to the remaining part of a bottom hole assembly, a plug or similar type of equipment is typically interrupted. Thereby, in the prior art certain well intervention operations are performed by a series of sequential runs required by the overall operation, compare for example WO2013115655A1 "A METHOD AND AN APPARATUS FOR RETRIEVING A TUBING FROM A WELL".

Thus, as described above the known downhole tools and methods of performing downhole operations suffer from time-consuming iterative downhole operation sequences causing undesired long interruptions of well intervention operations.

The invention has for its object to remedy or to reduce at least one of the drawbacks of the prior art, or at least provide a useful alternative to prior art.

A second object of the invention is to provide for a system and method for retrieving tubular from a well that is more time and cost efficient than current systems and methods.

The object is achieved through features, which are specified in the description below and in the claims that follow.

The invention is defined by the independent patent claims. The dependent claims define advantageous embodiments of the invention.

In a first aspect the invention relates to an interface tool for connecting a first tool string section with a second tool string section. The interface tool is configured for allowing a variable relative displacement between said tool string sections while keeping connection between said sections, wherein the connection is provided by a variable length wire running between the first tool string section and the second tool string section to enable the displacement.

The effects of the combination of the features of the invention are as follows. The invention enables the formation of a tool string assembly, which comprises of two or more tool string sections, which may be displaced relative to each other of a certain length, while still connection is maintained between these sections. This feature opens up a numerous variety of downhole operation sequences that may be carried out in a single run of the tool string assembly. For example, after being lowered into the well, the first tool string section performs an operation or action first, where after the second tool string section is displaced (and the first section remains at its position) relative to the first, and then performs a further operation or action. Thus in this way multiple operations may be carried out, and over a larger distance from each other, in a single run of the tool string assembly, whereby the interruptions are shorter and less frequent. The discussion of the further embodiment will further illustrate that there are many options rendered possible by the invention, and that there are various possibilities of operational use.

In an embodiment of the interface tool of the invention the variable length wire is non-telescopic or non-extendable. In an embodiment of the interface tool of the invention the first tool string section and a second tool string section remain electrically and/or physically connected while being displaced. In an embodiment of the interface tool of the invention the variable relative displacement has a maximum that is defined by a length of the variable length wire.

In an embodiment of the interface tool according to the invention the interface tool further comprises a reel system for storing the variable length wire. This embodiment conveniently provides a first manner of providing a variable length wire between the tool string assemblies.

In an embodiment of the interface tool according to the invention the interface tool has been integrated in an individual downhole tool that is coupled between the first tool string section and the second tool string section. This embodiment constitutes a further option, compared to the previously discussed embodiment, namely that the interface tool (having the displacement functionality) is integrated into an individual downhole tool that can be coupled (for instance in a conventional manner) in between the conventional tool string sections.

In an embodiment of the interface tool according to the invention the interface tool has been integrated into at least one of said tool string sections. It may be appreciated that as far as the interface tool is concerned, this system may be integrated in either one of the tool string sections, or even in both.

In an embodiment of the interface tool according to the invention the variable length wire is an electrical cable. After displacement is may be advantageous to still have electrical connection (for transferring power and/or data) between the sections through the electrical wire.

In an embodiment of the interface tool according to the invention the electrical cable comprising at least one conductor and which conductor may be isolated and/or shielded.

In an embodiment of the interface tool according to the invention the wire is an optical fibre. After displacement data and/or control signals may be transmitted between the sections through the optical fibre.

In an embodiment of the interface tool according to the invention the wire is a combination of an electrical cable and an optical fibre.

In a second aspect the invention relates to a string of downhole tools, hereinafter also denoted tool string assembly or bottom hole assembly comprising the interface tool of the invention. The invention may be embodied as a separate downhole tool forming the interface tool in accordance with claims 1 to 8, but also as a tool string assembly comprising the interface tool in accordance with the second aspect of the invention.

In an embodiment of the tool string assembly according to the invention the tool string assembly comprises the first tool string section, the second tool string section and the interface tool for connecting the first tool string section and the second tool string section. In this embodiment the displacement functionality has been added to a prior art downhole tool comprised in a prior art tool string assembly. The advantages and effects of this embodiment follow those of the corresponding embodiment of the interface tool.

In an embodiment of the tool string assembly according to the invention that the interface tool has been integrated into one of said tool string sections while being coupled to the other one. The advantages and effects of this embodiment follow those of the corresponding embodiment of the interface tool.

In an embodiment of the tool string assembly according to the invention the interface tool has been integrated in an individual downhole tool that is coupled between the first tool string section and the second tool string section. The advantages and effects of this embodiment follow those of the corresponding embodiment of the interface tool.

In an embodiment of the tool string assembly according to the invention the tool string assembly comprises a third tool string section connected to the second tool string section, and a further interface tool according to any one of claims 1 to 8 for connecting the third tool string section to the second tool string section. It may be appreciated that the invention may be repeated in that multiple interface tool are provided in between a cascading of three of more tool string sections as in this embodiment. This is particularly advantageous in embodiments where the variable length wire is stored in one of the sections, because it increases the maximum relative displacement length.

In an embodiment of the tool string assembly according to the invention a bottom one of the tool string sections comprises one of a group comprising: a gauge, a plug or other well completion equipment. This group of embodiments of the invention opens up a new variety of applications. For example, when plugs, gauges, or other well completion equipment (all of these than effectively forming one of the tool string sections in the interface tool of the invention) have been set, an electrical connection may be maintained while the other tool string section is moved to the surface.

In a third aspect the invention relates to a method for controlling a variable relative displacement between a first tool string section and a second tool string section, wherein the first tool string section is connected to a second tool string section via an interface tool, wherein the method comprises a step of:

allowing a variable relative displacement between said multiple tool string sections while keeping connection between said tool string sections through a variable length wire running between the first tool string section and the second tool string section to enable the displacement.

The method in accordance with the third aspect is considered as the broadest fingerprint (or gist) of the invention. The inventor is the first to realize this effect and benefit from its advantages.

In a fourth aspect the invention relates to a method for operating a tool string assembly of the invention, wherein the method comprises steps of:

providing the tool string assembly in a well;

performing operations or actions while the tool string assembly resides in the well;

the steps in accordance with the method for controlling a variable relative displacement of the invention;

performing further operations or actions while the tool string sections are relatively displaced, and removing the tool string assembly from the well.

The new downhole operation methods in accordance with the invention enables various possibilities of operational use. Nevertheless, the method as described in accordance with the fourth aspect of the invention describes the general fingerprint of all these methods, namely that downhole operations or actions are carried out, before and after the relative displacement of the tool string sections, while the sections remain connected during the displacement and the operations or actions.

In a fifth aspect the invention relates more particularly to an apparatus for retrieving a tubing from a well at least partly filled with a liquid, the tubing having a first end portion and a second end portion. The apparatus comprises:

an engagement means for engaging the tubing;

a sealing means for sealing the first end portion of the bore of the tubing;

injection means for injecting a low density fluid into the tubing in or at an elevation below, the sealing means; and connecting means to a surface of the well.

The apparatus further comprises a first tool string section, a second tool string section and the interface tool according to any one of the preceding claims. The interface tool is configured for connecting the first tool string section and the second tool string section. The first tool string section is provided with the engagement means, the sealing means, the injection means and the connection means. The second downhole equipment is provided with a sealing means for sealing off the second end portion of the tubing, such as a mechanical plug comprising a check valve, and a cutting tool for cutting the tubing underneath the sealing means. This embodiment of the invention achieves the second object, because the apparatus (a single tool string) of the invention may be used to carry out multiple steps of the removal process, while in the prior art multiple tool strings were needed. This is further explained with reference to the method claims.

An embodiment of the apparatus of the invention further comprises a control module comprising one or a combination of; means for controlling the engagement means;

means for controlling the sealing means; one or more sensor means selected from of the group comprising: pressure sensor, temperature sensor, acceleration sensor, velocity sensor.

In an embodiment of the apparatus of the invention the control module is further provided with at least one valve for communicating a fluid into or out of the tubing.

In an embodiment of the apparatus of the invention the control module further comprising means for disconnecting the connecting means from the apparatus.

In an embodiment of the apparatus of the invention the apparatus is further provided with a pumping device arranged for evacuating a liquid contained between the sealing means and a packer arranged in the bore of the tubing between the sealing means and the second end portion of the tubing.

In an embodiment the connection means comprise a cable configured for transferring control signals and power from the surface to the apparatus. The cable may be an armoured electrical cable capable of carrying the load from the apparatus and any other items connected or attached thereto.

In a sixth aspect the invention relates more particularly to a method for retrieving a tubing from a well at least partly filled with a liquid, the tubing having a first end portion and a second end portion. The method comprises the steps of:

- running the apparatus of claim 9 into the well using the connecting means from the surface;
- placing the apparatus at the second end portion of the tubing;
- installing the sealing means for sealing off the second end portion of the tubing;
- pulling the first tool string section up to the first send portion, while the second tool string section remains connected via the variable length wire;
- connecting the engagement means to the first end portion of the tubing;
- activating the sealing means to seal off liquid communication in the bore of the tubing between the first end portion and the second end portion;
- replacing at least a portion of a volume of liquid by a low density fluid introduced in said volume by the injection means;
- cutting the tubing using the cutting tool in the second tool string section, and
- retrieving the tubing out of the well using the connecting means.

This method significantly improves on the method discloses in WO2013115655A1, because three sequential steps are now performed by a single tool string (instead of three), namely: a) the cutting of the tubing (first tool string), b) the sealing off of the lower end of the tubing segment (second tool string), and c) the anchoring and sealing off of the top end of the tubing segment, the injection of the low density fluid, and the retrieval of the tubing segment (third tool string).

In an embodiment of the method of the invention the volume of liquid is defined by the sealing means, the tubing and the second end portion of the tubing. Thus, the low-density fluid is injected directly into the liquid.

In an embodiment of the method of the invention the sealing means comprises an inflatable bladder arranged to be filled with the low-density fluid so that the low-density fluid replaces the volume of liquid by increasing the volume of the bladder.

In an embodiment of the method of the invention the low-density fluid is supplied from the surface of the well through a line extending from the surface to the apparatus.

In an embodiment of the method of the invention the low-density fluid is supplied from a vessel operable to communicate low-density fluid to the injection means, the vessel being arranged between the apparatus and the surface of the well.

In an embodiment of the method of the invention the low-density fluid is supplied from both the surface of the well and from the vessel.

An embodiment of the method of the invention further comprises the step of controlling the buoyancy of the tubing during retrieval by replacing a volume of the low-density fluid in the tubing by a liquid.

Although a low-density fluid in the form of a gas is preferred for increasing the buoyancy of the tubing, the low-density fluid may also be a liquid having a lower density than the heavy fluid to be replaced. Thus, a condensate or even water may be used, for example. However, in the description below the low density fluid will be referred to as gas, but should not exclude other appropriate fluids having a density lower than the heavy fluid to be replaced.

In the following is described an example of a preferred embodiment illustrated in the accompanying drawings, wherein.

Figure 1:
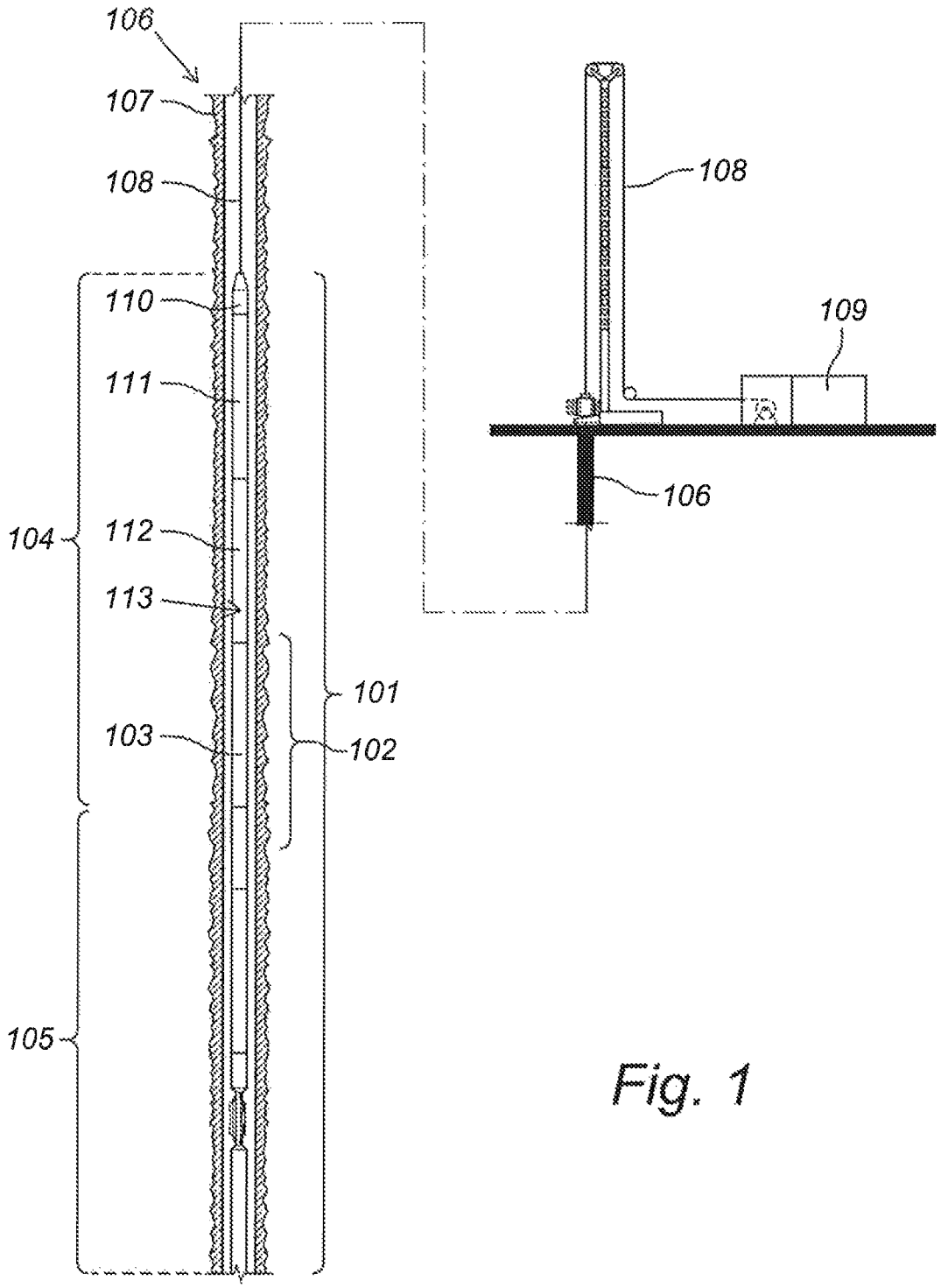
FIG. 1 shows a tool string assembly in accordance with an embodiment of the invention, wherein the tool string assembly is lowered down in a well by using a wireline.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage. Throughout the Figures, similar or corresponding features are indicated by same reference numerals or labels.

FIG. 1 shows a tool string assembly 101 (from now on also being referred to as a tool string) of the type used in oil and/or gas wells 106 and also being referred as bottom hole assembly. The tool string 101 is provided with an interface tool 102. The interface tool comprises an individual downhole tool 103 (from now on also being referred to as a release tool). FIG. 1 shows the release tool 103 as a wireline (or coiled tubing) downhole tool arranged in between other tools comprised by said tool string 101. Due to activation of a release mechanism in the release tool 103 the tool string 101 will be separated into two sections further referred as first tool string section 104 (or primary section) and second tool string section 105 (or secondary section).

In this example the tool string 101 is deployed in a well 106 with completion 107 by using an armoured electrical cable, further referred as a wireline 108. The wireline 108 is also used to power and control said tool string 101 by surface equipment 109. The bottom hole assembly 101 may also be configured to transmit measurement data or other signals to surface equipment 109 by the electrical conductor of said wireline 108.

As the range of tubular structure sizes and nominal weights commonly used in the industry as, for instance completion 107, is limited, the tools included in said a tool string 101 may be selected according to the inner dimension of the completion 107. Therefore, the size of interface tool 102 may also be adjustable to different tool sizes.

The bottom hole assembly 101 may further comprise a wireline connector 110, an electrical power section 111 and an electronics section 112. Reference is made to common wireline operations where the electrical power section 111 receives and transforms electrical power for the tool string 101. This electrical power is required to perform the intended downhole operations. The electronics section 112 performs downhole information processing, data exchange with the surface system 109 and/or data storage. This section of the tool string 101 is further referred as the primary section 104, because in this embodiment wireline connector 110 and electrical power section 111 are non-optional to perform downhole operations. The electronics section 112 may additionally include a position measurement device 113, such as common casing collar locator, to correlate the position of the tool string 101 with the ambient tubular structure (for example well completion 107 such as casing or production tubing).

Figure 2:
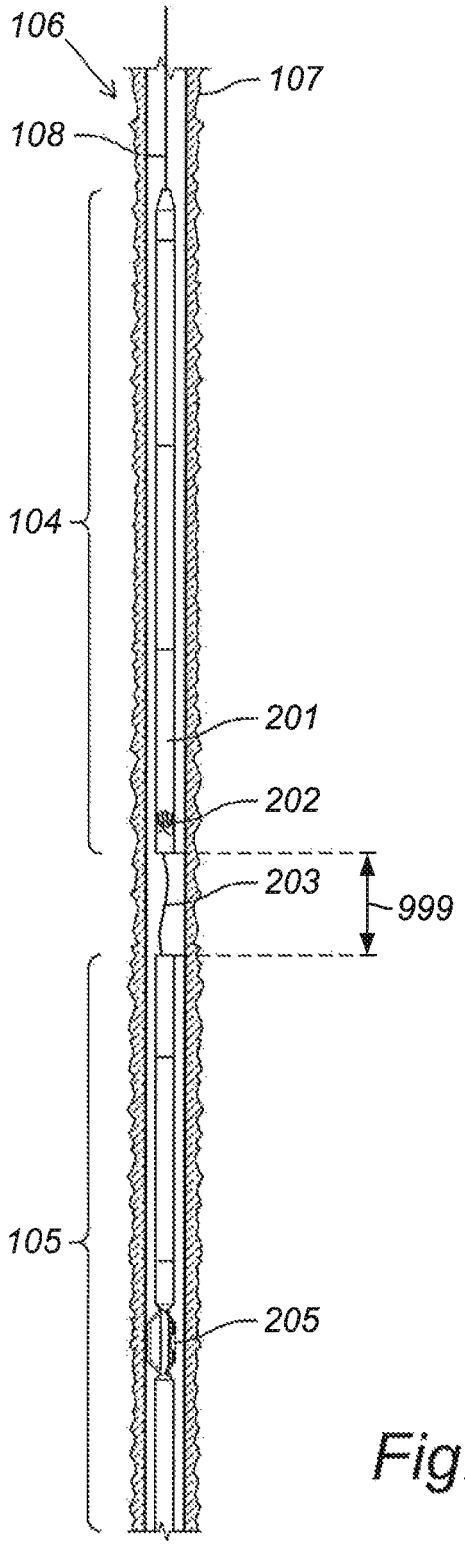
FIG. 2 shows the tool string assembly of FIG. 1, after that the tool string sections have been relatively displaced by pulling back the first tool string section a certain distance.

FIG. 2 shows the tool string assembly of FIG. 1, after the two tool string sections have been relatively displaced by pulling back the first tool string section a certain distance. In this embodiment the interface tool 102 comprises a housing 201, which housing 201 may consist of two or more parts, for housing a release mechanism and being separable by said release mechanism. Further to such common release mechanism the interface tool 102 according to the present invention may comprise a reel system 202 (from now on also being referred to as a wire reel unit) arranged, providing a predetermined limited length of a line 203. This line may be an isolated wire for example. The length and the type of such isolated wire may be adjusted to mechanical and/or electrical properties. This way, for example, electrical resistance and respective power loss may be optimised for certain tool string assemblies and/or operations.

In the event of separating the tool string 101 (as shown in FIG. 2) and thus relatively displacing the two sections 104 and 105 both separated sections remain connected by said line 203, which will be unspooled from the wire reel unit 202 simultaneously. FIG. 2 shows that the secondary section 105 has been placed at a certain position in the well 106 and is engaged to the well completion 107 by anchoring device 205 that is arranged in the secondary section 105. The primary section 104 has been pulled back a certain distance after separating from the secondary section 105.

Depending on the type of line 203 the separated tool string section 105, which is not connected anymore to any means for lowering the tool string 101 down into the well 106, may still be provided with electrical power, if line 203 is an isolated wire type. Furthermore the separated secondary section 105 may also be configured to transmit measurement data or other signals, for example to the primary section 104 of the tool string 101, which may be still connected to means for operating and controlling the tool string 101 in the well 106. Thereby the tools comprised in the secondary section 105 may still be controlled from surface.

It is evident from FIG. 2 that the distance 999 in between the two separated sections 104 and 105 is, in this embodiment, limited to the provided length of line 203. This length may be limited of several factors. First it is limited if line 203 is an isolated wire type, wherein the length of such isolated wire 203 may be limited by its mechanical but also by its electrical properties. Furthermore, the length of line 203 is limited by the length storage capacity of the wire reel unit 202. More details about the wire reel unit are discussed with reference to FIG. 3.

It must be stressed that the use of an isolated wire is just an embodiment of the invention. The invention is not limited to such embodiment. The line could also be an optical fibre, for example. In case of using an optical fibre as line 203, some of the other parts, for example sealed electrical connectors, have to be exchanged with appropriate optical connector parts. All such implementation aspects and modifications are considered as known by the person skilled in the art.

In the description until here and the description that follows embodiments with a reel system are elaborately discussed. However, it must be stressed that the invention is not limited to embodiments with reel systems, because there are also other ways in achieving the effect of providing a variable relatively displacement 999 between a first tool string section (first section 104) and a second tool string section (second section 105) while keeping said sections connected through a variable length wire. That is the gist of the invention as claimed.

Figure 3:
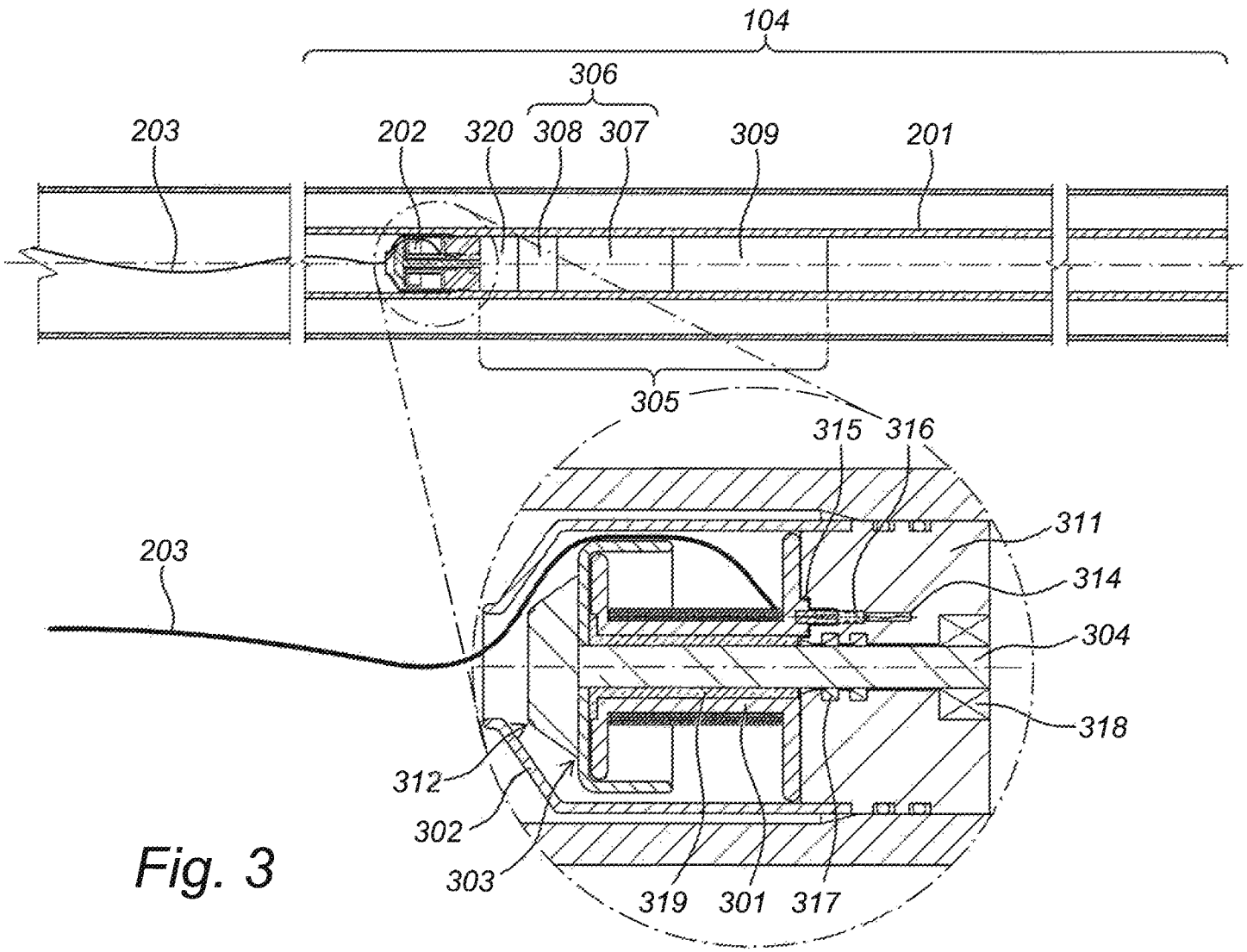
FIG. 3 shows the first tool string section of FIGS. 1 and 2 to a larger scale.

A cross section of the wire reel unit 202 is shown in FIG. 3 to a larger scale. In a preferred embodiment said wire reel unit 202 is arranged inside the housing 201 and comprises:

a line spool 301 providing a predetermined limited length of a line 203, which line 203 is connected to the electronics of both tool string sections 104 and 105;

a reel cover 302;

a rotor assembly 303, which may consist of one or more parts, and which rotor assembly 303 is mounted on a shaft 304 extending through the line spool 301; and a driving unit 305.

The driving unit 305 comprises: i) a gearbox-motor assembly 306, which comprises at least one actuator 307 and at least one transmissions 308; and ii) electronics (motor controller) 309 placed inside the housing 201 (which may be a pressure housing). Furthermore, the housing 201 comprises a body 311 for supporting line spool 301 and reel cover 302. The rotor assembly 303 is selectively driven (rotation) and axial displaced by the driving unit 305 and thus moved relative to the line spool 301 and to the reel cover 302. Similar reel systems can be found in fishing reels. Reference is made to U.S. Pat. No. 5,388,776, entitled "FISHING REEL AND FEATHERING ASSEMBLY THEREFOR".

FIG. 3 shows the position of the rotor assembly 303, which allows the line 203 to be unspooled simultaneously to the separation of the tool string 101. In this particular position feathering means 312 (typically a plurality of discrete line engaging means), which are comprised in the rotor assembly 303, are not engaged to the line 203. Thus, line 203 can be unspooled and bridge the distance between the two separated sections 104 and 105 of the tool string 101. Thereby, depending on the type of line 203, electrical power supply and/or telemetry to all tools can be pursued; also and especially for the separated secondary section 105.

By moving the rotor assembly 303 towards the reel cover 302 and simultaneous rotational movement of the rotor assembly 303 the feathering means 312 engage line 203. Because the line spool 301 remains still whilst the rotor assembly 303 is rotating line 203 is spooled onto the line spool 301. The rotational movement of line spool 301 is disabled by a form fitting geometry 315 used for connecting line spool 301 and body 311, which form fitting geometry 315 has also an electrical and/or optical feed through 314 arranged. A sealed electrical connector 316 is used to connect line 203 and the feed through 314 (in this embodiment shown as an electrical wire), which extends through the driving unit 305 to the electronics section 112 of the primary section 104.

For preventing well fluids migrating into the driving unit 305 the body 311 is connected to and placed inside a pressure housing 201 as the electronics 309 of the driving unit 305. Further the shaft 304 extends through sealing means 317 which are arranged inside body 311, which body 311 also having a bearing 318 arranged to support shaft 304. The shaft 304 is further supported by a sleeve bearing 319, which is arranged inside the line spool 301.

Further, the shaft 304 is coupled to the drive shaft of the driving unit 305 by a suitable coupling 320 comprised in the driving unit 305.

It must be noted that line spool 301, reel cover 302 and rotor assembly 303 are illustrated with cylindrical surfaces. However, in another embodiment these surfaces (especially the cylindrical surface of the line spool 301) may be designed conical, e.g. to improve unspooling performance.

Figure 4:
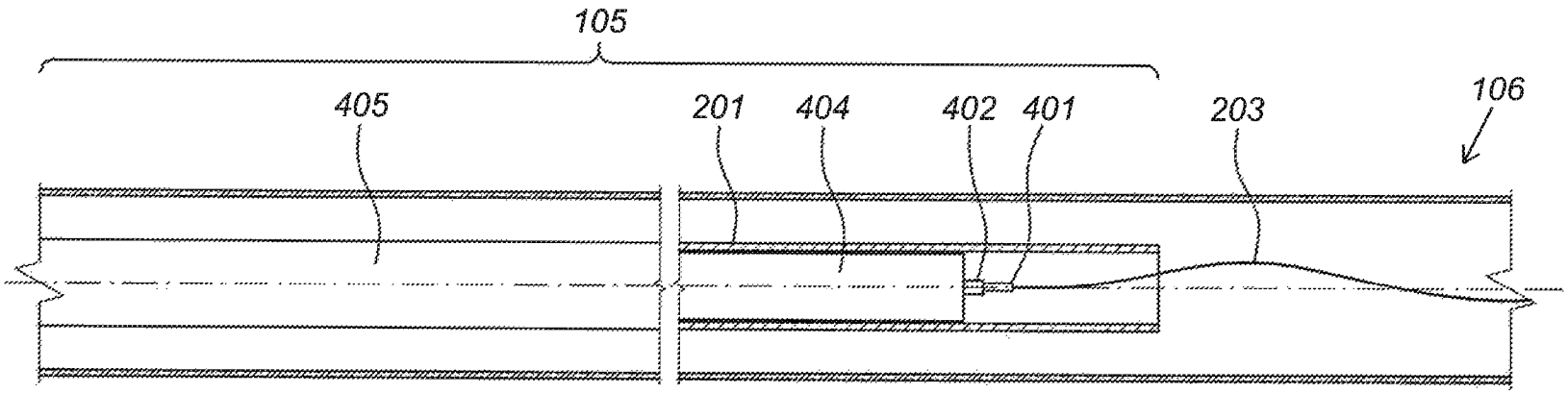
FIG. 4 shows the second tool string section of FIGS. 1 and 2 to a larger scale.

As illustrated in FIG. 4, the interface tool 102 may further comprising:

a sealed electrical connector, also referred as line connector 401 with pressure bulkhead 402 being arranged within the secondary section 105, providing appropriate cable anchorage and preventing any gas or fluid getting inside this separated section; and one or more electronics sections 404, being arranged within the primary and secondary sections 104 and 105, performing downhole information processing, data exchange within the separated tool string sections 104 and 105, and/or data storage.

Depending on the particular embodiment, for instance if line 203 is an optical fibre and only used for data exchange, the secondary section 105 may also include a battery section 405 providing electrical power for the separated secondary section 105.

There are many variations possible on the embodiment of the interface tool and tool string assembly that has been discussed with reference to the figures. A number of alternatives is discussed herein after.

Even though most embodiments discussed disclose an interface tool using a reel system for (un)winding up a wire or line running between the tool string sections, it must be stressed that the invention is not limited to the use of a reel system for (un)winding the wire or line. Simply, because there are other ways to achieve a wire having a variable length.

In an alternative embodiment the wire reel unit 202 may also be used to spool the line 203 while the interface tool 102 is operated in the well, for example simultaneously to re-connecting the two separated sections 104 and 105 of the tool string 101 downhole. By spooling slack line 203 it may be ensured that the line 203 will not be damaged due to mechanical re-connecting of the two tool string sections 104 and 105.

In an alternative embodiment the tool string 101 may have two or more of interface tool 102 arranged to separate the tool string 101 into three or more sections for performing other downhole operations not previously described.

An alternative embodiment of interface tool 102 may be used for maintaining communication to (temporarily) installed downhole equipment, such as gauges, plugs or other well completion equipment. Temporarily here means with regards to the entire "lifetime" of a well associated with the production of hydrocarbons, for example a period of 5 years. In this embodiment line 203 may only be used for transmitting data from the particular downhole equipment to surface and thus line 203 does not need to be an armoured electrical cable, such as wireline 108, capable to support the weight of an entire tool string. The breaking length/tension length of said line 203 just needs to be sufficient to support line 203 itself. Thus, communication with installed equipment can be maintained even after the well intervention operation has been done and the wireline setup has been demobilised and removed from the well.

This alternative used may be beneficial in regards to prior art plugging and abandoning regulations, such as NORSOK D-010, limiting the maximum period of abandoning a well temporarily depending on the option whether the well is monitored or not.

In yet another embodiment the shaft 304 may be used to house the feed through 314. Because the shaft 304 moves in relation to the body 311 the shaft may be equipped with an electrical spring contact, which provides electrical connection to a conductive ring (or vice versa) while the shaft 304 and rotor assembly 303 are driven. A similar configuration may be used to electrically connect the feed through 314 and the electronics section 309.

A major benefit of the non-rotating line spool 301 is that no complex electrical and/or no optical swivels are necessary to connect the spooled line 202 and the electronics of the interface tool 102.

Furthermore, it may be beneficial to arrange one or two additional guide ring(s) (not shown), which are:

alternatingly moved longitudinal to the line spool 301 whilst spooling line 202; or which additional guide ring remains in position while the line spool 301 is alternatingly moved longitudinal.

Thereby line 203 may be spooled in a certain pattern and thus the capacity of line spool 301 may be utilised efficiently.

However, if this method/this interface tool is only used to provide an unspooled line once per run/downhole operation the line spool 301 can be exchanged during regular repair and maintenance cycles and line 203 can be spooled separately during repair and maintenance cycles.

It is important to note that the description of WO2013115655A1 is herewith incorporated by reference in this document in its entirety. WO2013115655A1 is referred to hereinafter as DOC1. All subject matter disclosed in that document is considered included in this document.

The method of DOC1 describes three sequential operation steps being performed by individual tool strings:

a) cutting the tubing;

b) sealing off the lower end of the tubing segment;

c) anchoring and sealing off the top end of the tubing segment, injecting lighter fluid and retrieving the tubing segment.

Using a certain release tool providing a limited wired connection after separation enables operator to perform the same technique by utilising and running a single tool string and a slightly modified method. Expressed differently, the interface tool of the invention renders it possible to make the method of retrieval of a tubing DOC1 simpler and faster. FIGS. 5 to 8 serve to illustrate how the method and apparatus, which disclosed in that document, are changed by the invention. It is important to note that a few items in DOC1 have been renumbered in order to prevent conflicts with the numbering used in this description. The renumbering has been done as follows:

The well with reference number 100 is renumbered to 3100 in this description;

The casing of a well with reference number 107 is renumbered to 3107 in this description;

The tubing of a well with reference number 108 is renumbered to 3108 in this description;

The cutting tool with reference number 506 is renumbered to 3506 in this description, and The cable with reference number 507 is renumbered to 3507 in this description.

It must be noted that, hereinafter, the invention is only discussed in as far as it significantly differs from the disclosure of DOC1. Instead of inserting and using a cutting tool for cutting a lower portion of the tubular, as illustrated in FIG. 12 in DOC1, a different apparatus (tool string) is used in the invention. In the invention the step of cutting the tubing is not done in the exactly the same stage as in DOC1. Expressed differently, the step illustrated in FIG. 12 in DOC1 is postponed.

Figure 5:
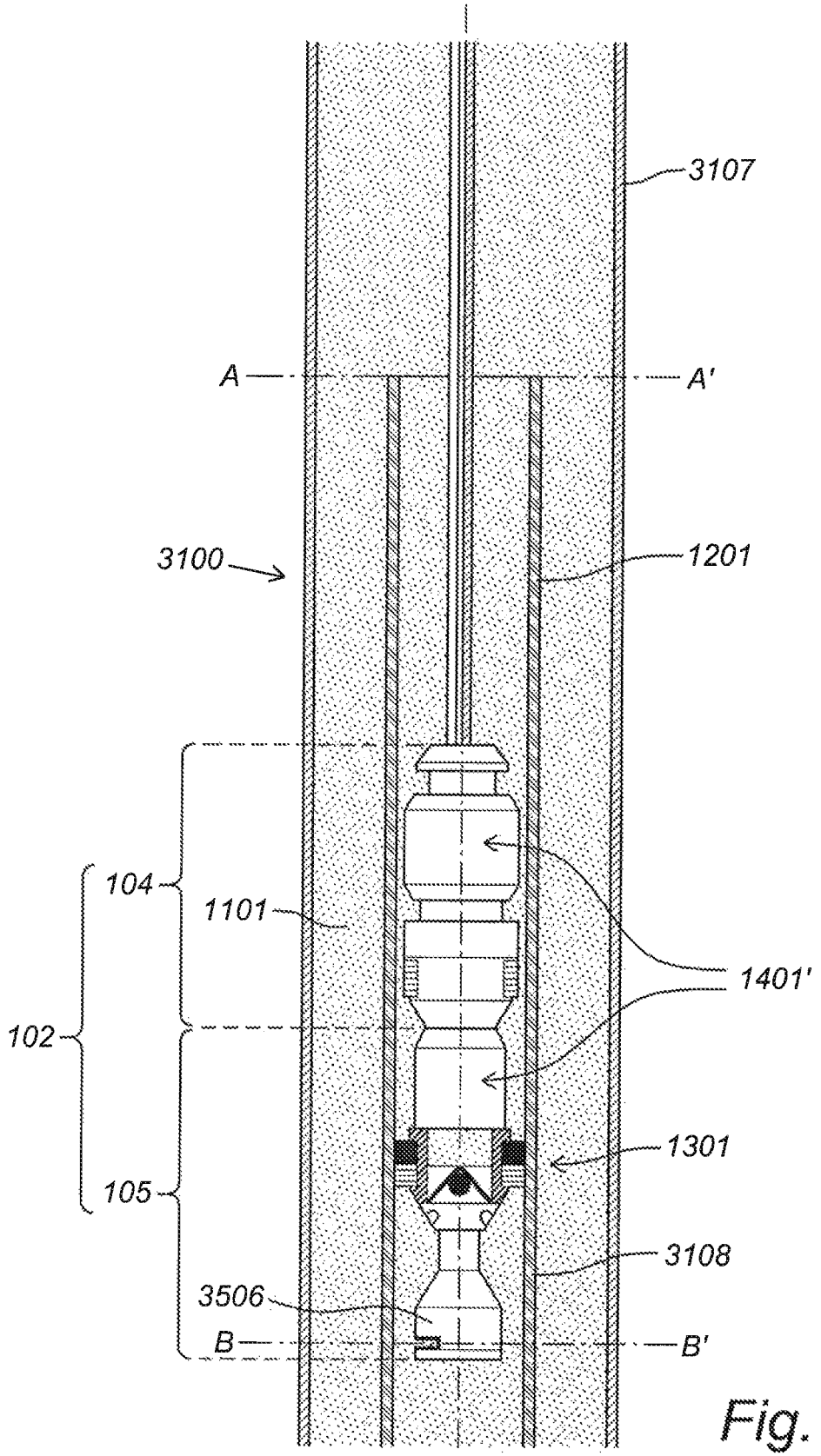
FIG. 5 shows an intermediate stage of an embodiment of a method of retrieving a tubing from a well in accordance with the invention.

FIG. 5 shows an intermediate stage of an embodiment of a method of retrieving a tubing from a well (having a casing 3107) in accordance with the invention. This figure substitutes FIG. 13 in DOC1. In this stage of the method an improved apparatus 1401' for retrieving a tubing 3108 from a well has been positioned in the well 3100. FIG. 5 discloses an apparatus 1401' for retrieving a tubing segment 1201 from a well 3100 at least partly filled with a liquid 1101, the tubing segment 1201 having a first end portion A-A' and a second end portion B-B'. The apparatus 1401' further comprises:

an anchor (engagement means) 1403 for engaging the tubing segment 1201;

a sealing module (sealing means) 1404 for sealing the first end portion A-A' of the bore of the tubing segment 1201;

injection means for injecting a low density fluid 1501 into the tubing segment 1201 in or at an elevation below, the sealing means 1404; and a cable (connecting means) 3507 to a surface of the well 3100.

In this example an armoured electrical cable, further referred as a wireline, is used to power and control said apparatus 1401' by respective surface equipment.

The modified apparatus 1401' is characterized in that it comprises a first tool string section 104, a second tool string section 105 and the interface tool 102 according to the invention. The interface tool 102 is configured for connecting the first tool string section 104 and the second tool string section 105, wherein the first tool string section 104 is provided with the engagement means 1403, the sealing means 1404, the injection means and the connection means 3507. The second downhole equipment 105 is provided with a sealing means 1301 for closing the second end portion B-B' of the tubing, such as a mechanical plug comprising a check valve, and a cutting tool 3506 for cutting the tubing underneath the sealing means 1301.

In FIG. 5 the apparatus 1401' is lowered down into the well until the second tool string section 105 is located at the dedicated lower portion of the tubing segment 1201. As already discussed, the second tool string section 105 comprises at least the sealing means 1301, such as a mechanical plug comprising a check valve, the cutting tool 3506 and part of the interface tool 102.

Figure 6:
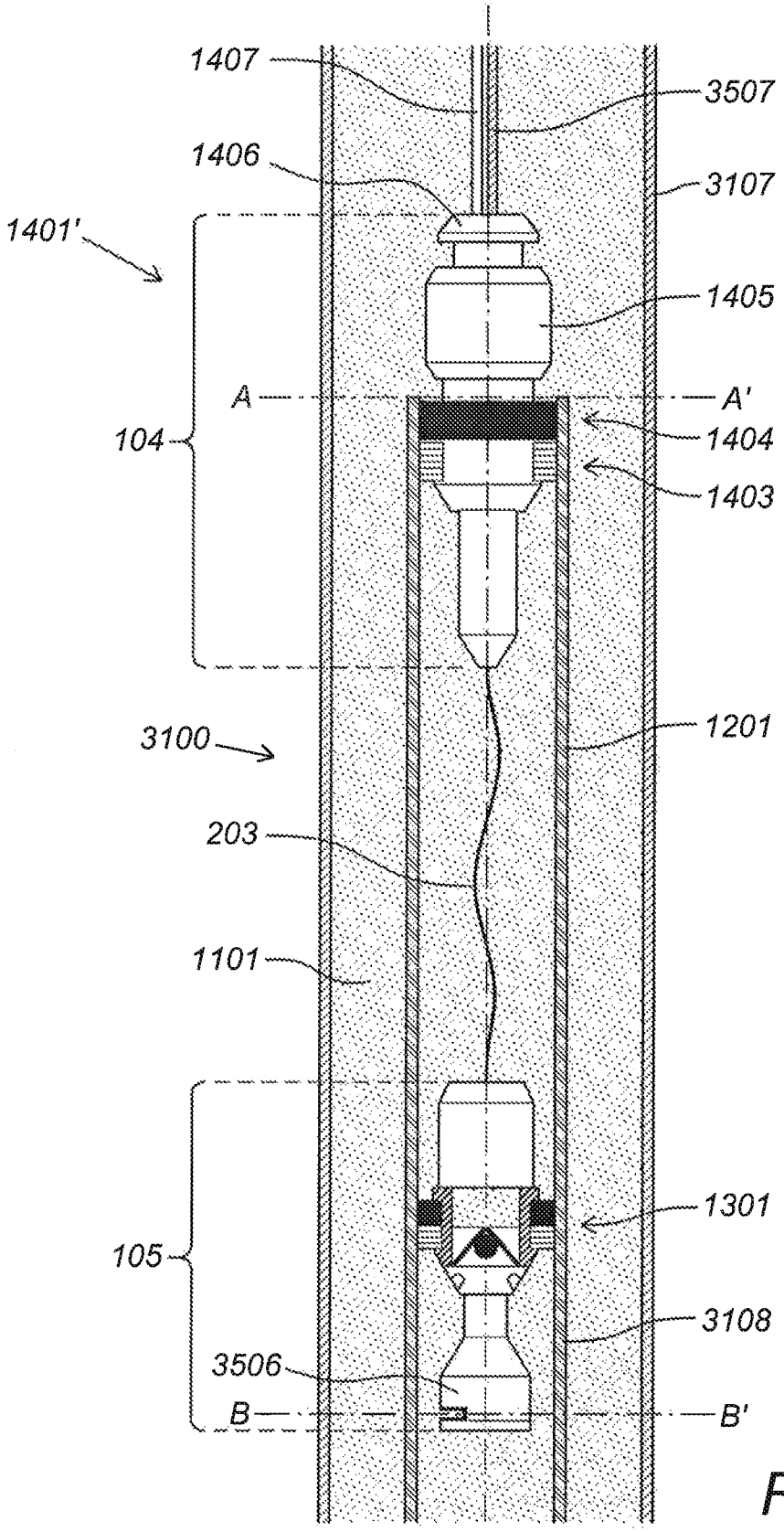
FIG. 6 shows another stage of an embodiment of a method of retrieving a tubing from a well in accordance with the invention.

After installing the sealing means 1301 the second tool string section 105 may be separated from the first tool string section 104 of said tool string 1401', which may be pulled back to the position of the upper end portion A-A'. This is illustrated by FIG. 6 showing another stage of the method. FIG. 6 substitutes FIG. 14 in DOC1. The second tool string section 105 remains connected and provided with electrical power and data transmission using the variable length wire 203, for example the electrical conductor of a separate isolated cable, which forms part of the interface tool 102.

The first tool string section 104 of the apparatus (tubing retrieval tool) 1401' further comprises the engagement means in the form of an anchoring module 1403, the sealing means in the form of a seal module 1404 for sealing off a top section of the tubing segment 1201, a control module 1405 and a termination module 1406 where the wireline cable 3507 and/or hydraulic line 1407 and/or coil tubing are terminated. FIG. 6 further illustrates that the retrieval apparatus 1401' according to the invention is engaged to the tubing segment 1201 through the sealing module 1404.

Figure 7:
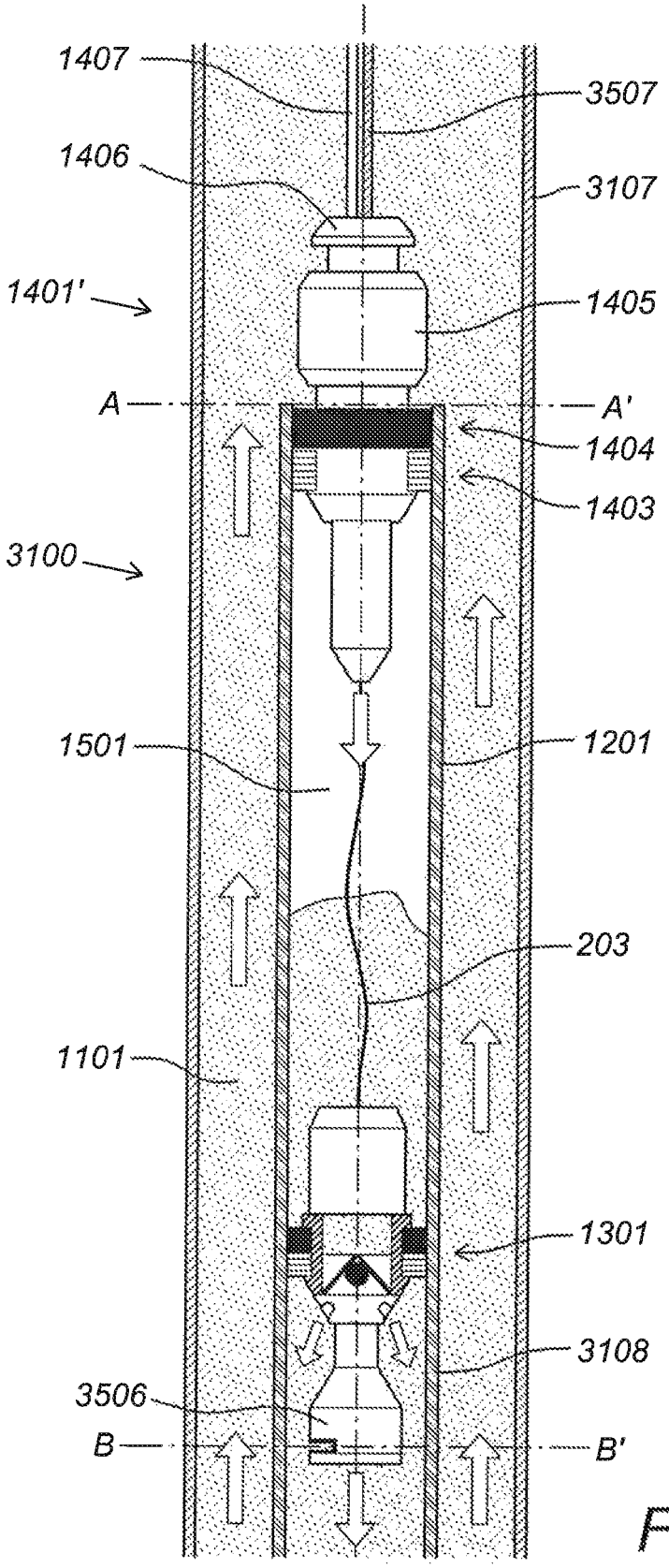
FIG. 7 shows another stage of an embodiment of a method of retrieving a tubing from a well in accordance with the invention.

FIG. 7 shows another stage of an embodiment of a method of retrieving a tubing from a well in accordance with the invention. This figure substitutes FIG. 15 in DOC1. This figure illustrates a key step according to the method of DOC1, wherein a top portion of the tubing segment 1201 is filled with the low density fluid 1501 in the form of gas, such as for example, but not limited to, nitrogen or other suitable gases. The liquid is 1101 is communicated out of the tubing segment 1201 via an aperture provided by the sealing means 1301, such as a mechanical plug comprising a check valve and one or more fluid ports. Furthermore, in some embodiments of the method the liquid 1101 is communicated between the centre of the tubing and 3108 and the annulus between the tubing and the casing 3107 via an aperture (similar to FIG. 3 of DOC1), such as punch holes, further down the tubing 3108. This is particularly important in embodiments where the cutting of the tubing is done at a later stage (as illustrated in FIGS. 5 to 8). The liquid flow is indicated by the arrows. After the tubing segment 1201 is filled with the low density fluid 1501, especially in vertical well sections, the compressive force that is normally present in the tubing 3108, which is supported only at its bottom end, is reduced by the increased buoyancy force. The combination of increased buoyancy force and applied wireline working tension may preferably fully compensate said compressive force.

Figure 8:
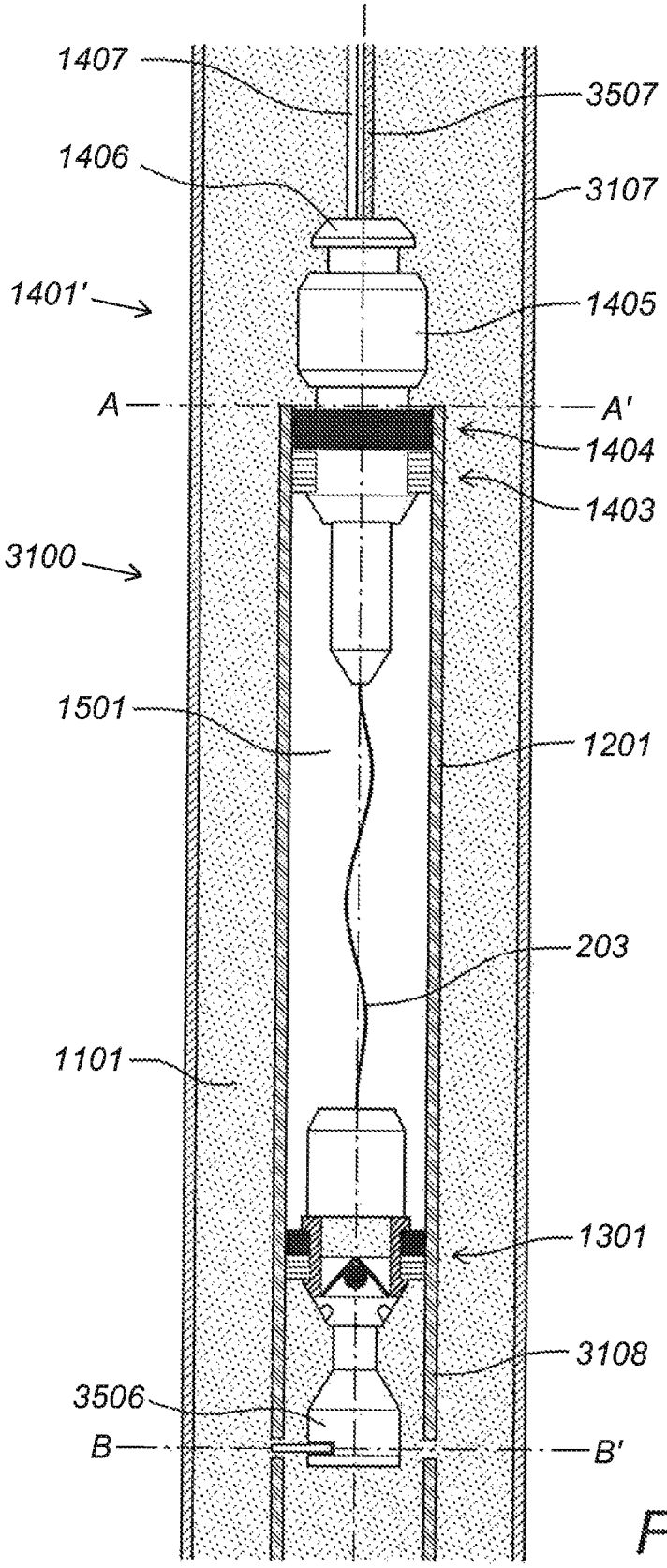
FIG. 8 shows yet another stage of an embodiment of a method of retrieving a tubing from a well in accordance with the invention.

FIG. 8 shows yet another stage of an embodiment of a method of retrieving a tubing from a well in accordance with the invention. This figure, at least to a certain extent, substitutes FIG. 12 in DOC1, but this needs some further explanation. In the method of DOC1 it is essential that the cutting is carried out before the setting of the sealing means 1301. In an embodiment of the method of the invention, however, this could be easily done at a later stage, because the cutting tool 3506 has been integrated in the second tool string section 105 and already resides below the sealing means 1301.

In the embodiment illustrated in FIGS. 5 to 8 this has even been postponed to after the filling with the low-density fluid. This has as a clear advantage that the buoyance force may improve the cutting process as the compressive force that may be present in the tubing 3108 is reduced or even annihilated while the tubing is being cut. The consequence is that even mechanical cutting tools may be utilised to perform cut at the second end portion B-B' of the tubing segment 1201. However, it must be stressed that the cutting may also be done in an earlier stage, for instance, right after setting the sealing means 1301.

For all other details, background information, and enabling features reference is made to DOC1.

The invention claimed is:

1. An apparatus for retrieving a tubing from a well at least partly filled with a liquid, the tubing having a first end portion (A-A') and a second end portion (B-B'), said apparatus comprises:

an engagement means for engaging the tubing;

a first sealing means for sealing the first end portion (A-A') of the bore of the tubing;

injection means for injecting a low density fluid into the tubing in or at an elevation below the first sealing means; and connecting means to a surface of the well, a first tool string section, a second tool string section and an interface tool configured for connecting the first tool string section and the second tool string section, wherein the first tool string section is provided with the engagement means, the first sealing means, the injection means and the connection means, and wherein a second downhole equipment is provided with a second sealing means for sealing off the second end portion (B-B') of the tubing, for cutting the tubing underneath the second sealing means.

2. An apparatus according to claim 1, wherein the connection means comprise a cable configured for transferring control signals and power from the surface to the apparatus.

3. The apparatus according to claim 1 wherein the second sealing means is a-mechanical plug comprising a check valve.

4. A method for retrieving a tubing from a well at least partly filled with a liquid, the tubing having a first end portion (A-A') and a second end portion (B-B'), said method comprises the steps of:

running the apparatus of claim 1 into the well using the connecting means from the surface;

placing the apparatus at the second end portion (B-B') of the tubing;

installing the second sealing means for closing the second end portion (B-B') of the tubing;

pulling the first tool string section up to the first end portion (A-A'), while the second tool string section remains connected via the variable length wire;

connecting the engagement means to the first end portion (A-A') of the tubing;

activating the first sealing means to close liquid communication in the bore of the tubing between the first end portion (A-A') and the second end portion (B-B');

replacing at least a portion of a volume of liquid with a low density fluid introduced in said volume by the injection means;

cutting the tubing using the cutting tool in the second tool string section, and retrieving the tubing out of the well using the connecting means.

5. The method according to claim 4, wherein the volume of liquid is defined by the first sealing means, the tubing and the second end portion (B-B') of the tubing.

6. The method according to claim 4, wherein the first sealing means comprises an inflatable bladder arranged to be filled with the low density fluid so that the low density fluid replaces the volume of liquid by increasing the volume of the bladder.

7. The method according to claim 4, wherein the low density fluid is supplied from the surface of the well through a line extending from the surface to the apparatus.

8. The method according to claim 4, wherein the low-density fluid is supplied from a vessel operable to communicate low-density fluid to the injection means, the vessel being arranged between the apparatus and the surface of the well.

9. The method according to claim 8, wherein the low-density fluid is supplied from both the surface of the well and from the vessel.

10. The method according to claim 4, further comprising controlling the buoyancy of the tubing during retrieval by replacing a volume of the low-density fluid in the tubing with a liquid.

* * * * *